US012478104B2

(12) United States Patent
Moloney

(10) Patent No.: US 12,478,104 B2
(45) Date of Patent: Nov. 25, 2025

(54) AEROSOL GENERATION DEVICE HEATER ELEMENT MANUFACTURE

(71) Applicant: Nicoventures Trading Limited, London (GB)

(72) Inventor: Patrick Moloney, London (GB)

( * ) Notice: Subject to any disclaimer, the term of this patent is extended or adjusted under 35 U.S.C. 154(b) by 681 days.

(21) Appl. No.: 17/438,252

(22) PCT Filed: Mar. 9, 2020

(86) PCT No.: PCT/EP2020/056219
§ 371 (c)(1),
(2) Date: Sep. 10, 2021

(87) PCT Pub. No.: WO2020/182730
PCT Pub. Date: Sep. 17, 2020

(65) Prior Publication Data

US 2022/0183367 A1 Jun. 16, 2022

(30) Foreign Application Priority Data

Mar. 11, 2019 (GB) ..... 1903228

(51) Int. Cl.
*A24F 40/465* (2020.01)
*A24F 40/42* (2020.01)
*A24F 40/70* (2020.01)

(52) U.S. Cl.
CPC ..... *A24F 40/465* (2020.01); *A24F 40/42* (2020.01); *A24F 40/70* (2020.01)

(58) Field of Classification Search
CPC .... B21D 26/033; B21D 23/08; B21D 23/033; B21D 22/30; B21C 1/24; B21C 23/08; A24F 40/46; A24F 40/465; A24F 40/42; A24F 40/70; H05B 6/105
See application file for complete search history.

(56) References Cited

U.S. PATENT DOCUMENTS 3,217,521 A * 11/1965 Dilling ..... B21C 1/24 72/77
3,685,475 A 8/1972 Banks, Jr.
4,838,063 A * 6/1989 Nishiyama ..... B21C 1/24 72/47

(Continued)

FOREIGN PATENT DOCUMENTS

CN 108 495 386 9/2018
CN 109380766 A 2/2019

(Continued)

OTHER PUBLICATIONS

WO2018026022 w/translation (Year: 2018).*

(Continued)

*Primary Examiner* — Marcus E Harcum
(74) *Attorney, Agent, or Firm* — Daniel Bruzzone

(57) ABSTRACT

A method of manufacturing an aerosol generation system heater element is described. The aerosol generation system heater element comprising a seamless hollow tube, and the method comprises deforming a wall of a hollow tube to form the seamless hollow tube, the seamless hollow tube having a deformed wall, wherein the deformed wall of the seamless hollow tube is thinner than the wall of the hollow tube.

20 Claims, 5 Drawing Sheets

(56) References Cited

U.S. PATENT DOCUMENTS

| | | | | | |
|---|---|---|---|---|---|
| 5,076,084 | A * | 12/1991 | Furugen | B21C 1/24 | 72/283 |
| 5,533,376 | A * | 7/1996 | Wetzels | B21C 3/16 | 72/283 |
| 5,665,262 | A * | 9/1997 | Hajaligol | A24F 40/46 | 131/194 |
| 7,788,959 | B2 | 9/2010 | Hayashi | | |
| 8,245,553 | B2 * | 8/2012 | Hayashi | B21C 1/24 | 72/274 |
| 9,661,690 | B2 * | 5/2017 | Noel | H05B 3/12 | |
| 9,782,811 | B2 * | 10/2017 | Sung | B21C 25/04 | |
| 10,130,900 | B2 * | 11/2018 | Broadley | G01N 30/60 | |
| 10,188,146 | B2 * | 1/2019 | Chen | H05B 3/46 | |
| 10,856,576 | B2 * | 12/2020 | Mironov | A24F 40/465 | |
| 11,234,464 | B2 * | 2/2022 | Qiu | A24F 40/485 | |
| 11,632,978 | B2 * | 4/2023 | Rojo-Calderon | A24C 5/01 | 131/111 |
| 2001/0042297 | A1 * | 11/2001 | Wolf | B21C 37/154 | 29/458 |
| 2002/0017372 | A1 * | 2/2002 | Yano | B21C 23/10 | 164/113 |
| 2004/0200255 | A1 | 10/2004 | Newport et al. | | |
| 2008/0007088 | A1 * | 1/2008 | Newport | B21C 5/003 | 296/205 |
| 2009/0193868 | A1 | 8/2009 | Hayashi | | |
| 2012/0255567 | A1 | 10/2012 | Rose et al. | | |
| 2013/0192326 | A1 * | 8/2013 | Yamamoto | B21C 1/24 | 72/45 |
| 2014/0170919 | A1 * | 6/2014 | Manipatruni | D02G 3/441 | 442/330 |
| 2015/0090280 | A1 | 4/2015 | Chen | | |
| 2016/0001351 | A1 * | 1/2016 | Gunther | B21K 1/063 | 72/283 |
| 2016/0084433 | A1 * | 3/2016 | Wines | B21C 3/06 | 29/897 |
| 2016/0120221 | A1 * | 5/2016 | Mironov | A24F 40/42 | 392/395 |
| 2017/0325502 | A1 | 11/2017 | Nelson et al. | | |
| 2018/0014577 | A1 * | 1/2018 | Qiu | B05B 11/06 | |
| 2018/0064172 | A1 * | 3/2018 | Qiu | A61M 15/06 | |
| 2018/0343923 | A1 * | 12/2018 | Chen | A24F 40/485 | |
| 2019/0022730 | A1 * | 1/2019 | Dunwoody | B21D 51/26 | |
| 2019/0104764 | A1 * | 4/2019 | Tucker | H05B 3/04 | |
| 2019/0183182 | A1 * | 6/2019 | Tucker | H05B 3/42 | |
| 2019/0193131 | A1 * | 6/2019 | Froböse | C22C 38/001 | |
| 2019/0208813 | A1 * | 7/2019 | Rojo-Calderon | A24D 1/20 | |
| 2019/0335548 | A1 * | 10/2019 | Li | H05B 6/105 | |
| 2019/0380391 | A1 * | 12/2019 | Reevell | A24F 40/465 | |
| 2020/0346271 | A1 * | 11/2020 | Yuan | C22C 21/10 | |
| 2022/0183375 | A1 * | 6/2022 | Abi Aoun | H05B 6/108 | |

FOREIGN PATENT DOCUMENTS

| | | | | |
|---|---|---|---|---|
| EP | 0897271 | A1 | 2/1999 | |
| EP | 0957959 | A2 | 11/1999 | |
| EP | 2796219 | A1 | 10/2014 | |
| GB | 2311197 | A * | 9/1997 | H05B 6/105 |
| JP | S63102911 | A | 5/1988 | |
| JP | H0647432 | A | 2/1994 | |
| JP | H0740322 | A | 2/1995 | |
| JP | H07265994 | A | 10/1995 | |
| JP | H08511176 | A | 11/1996 | |
| JP | 2003275834 | A | 9/2003 | |
| KR | 1020050068051 | A | 7/2005 | |
| RU | 2519959 | C2 | 6/2014 | |
| WO | 93/10578 | A1 | 5/1993 | |
| WO | WO-9527412 | A1 | 10/1995 | |
| WO | WO 97/42993 | | 11/1997 | |
| WO | WO 98/23171 | | 6/1998 | |
| WO | WO-03106719 | A2 | 12/2003 | |
| WO | 2009096034 | A1 | 8/2009 | |
| WO | WO 2013/053003 | A1 | 4/2013 | |
| WO | WO-2013052558 | A1 | 4/2013 | |

OTHER PUBLICATIONS

International Search Report and Written Opinion for International Application No. PCT/EP2020/056219, dated Oct. 5, 2020, 20 pages.

"International Preliminary Report on Patentability received for PCT Patent Application No. PCT/EP2020/056219, mailed on Sep. 23, 2021", 12 pages.

"Invitation to Pay Additional Fees received for PCT Patent Application No. PCT/EP2020/056219, mailed on Jul. 8, 2020", 9 pages.

"Notice of Reasons for Rejection for Japanese Patent Application No. 2021-554587, mailed on Dec. 6, 2022", 10 pages (5 pages of English Translation and 5 pages of Official Copy).

"Office Action received for Russian Patent Application No. 2021126480, mailed on Aug. 19, 2022", 18 pages (9 pages of English Translation and 9 pages of Official Copy).

European Communication pursuant to Article 94(3) EPC in Application 20712228.4, mailed Mar. 24, 2025, 3 pages.

* cited by examiner

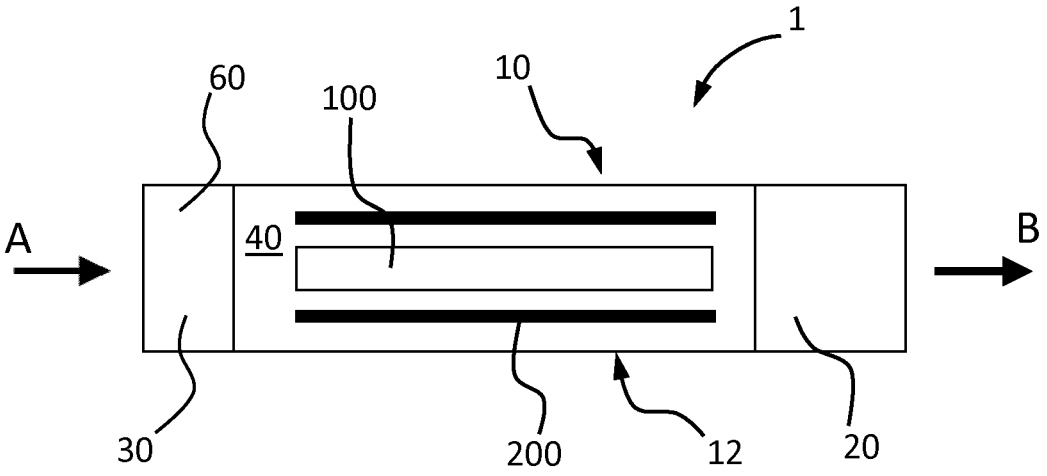
Figure 1
Figure 2
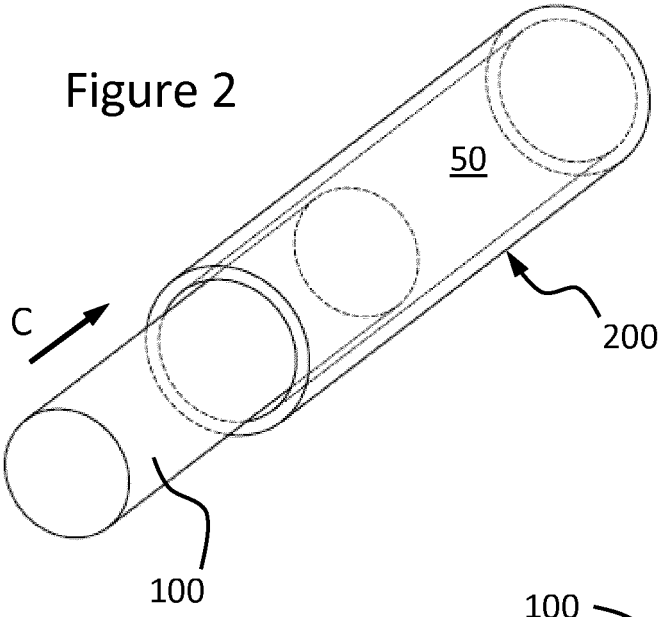
Figure 3
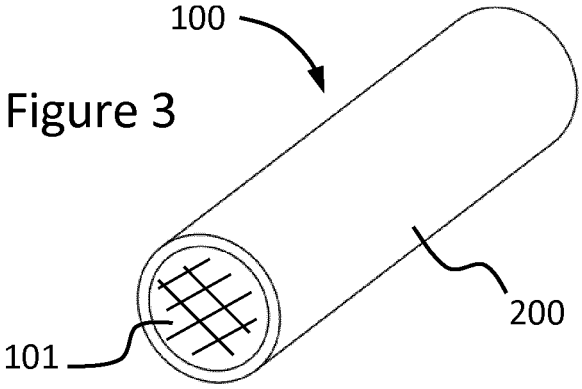

AEROSOL GENERATION DEVICE HEATER ELEMENT MANUFACTURE

CROSS-REFERENCE TO RELATED APPLICATIONS

This application is a National Phase entry of PCT Application No. PCT/GB2020/050605, filed Mar. 11, 2020, which application claims the benefit of priority to GB 1903288.7, filed Mar. 11, 2019, the entire disclosures of which are incorporated herein by reference.

TECHNICAL FIELD

The present disclosure relates to an aerosol generation system and to manufacturing an aerosol generation system heater element.

BACKGROUND

Smoking articles such as cigarettes, cigars and the like burn tobacco during use to create tobacco smoke. Attempts have been made to provide alternatives to these articles that burn tobacco by creating products that release compounds without burning.

Examples of such articles are heating devices which release compounds by heating, but not burning, the material. The material may be, for example, tobacco or other non-tobacco products, which may or may not contain nicotine. Heating tobacco or non-tobacco products may volatilise at least one component of the tobacco or non-tobacco products, typically to form an aerosol which can be inhaled, without burning or combusting the tobacco or non-tobacco products.

A heating device that heats the tobacco or non-tobacco product may be described as a 'heat-not-burn' apparatus or a 'tobacco heating product' (THP) or 'tobacco heating device' or similar. Various arrangements have been tried for volatilising at least one component of tobacco or non-tobacco products.

SUMMARY

A first aspect of the invention provides a method of manufacturing an aerosol generation system heater element, the aerosol generation system heater element comprising a seamless hollow tube, the method comprising: deforming a wall of a hollow tube to form the seamless hollow tube, the seamless hollow tube having a deformed wall, wherein the deformed wall of the seamless hollow tube is thinner than the wall of the hollow tube.

In an embodiment, the wall of the hollow tube has a first cross-sectional internal perimeter and the deformed wall of the seamless hollow tube has a second cross-sectional internal perimeter that is at least the same length as the first cross-sectional internal perimeter.

In an embodiment, the deformed wall of the seamless hollow tube has a second cross-sectional internal perimeter that is longer than the first cross-sectional internal perimeter.

In an embodiment, the seamless hollow tube has a substantially circular cross section.

In an embodiment, the deforming the wall of the hollow tube comprises hydroforming the hollow tube to expand the first cross-sectional internal perimeter of the hollow tube.

In an embodiment, the deforming the wall of the hollow tube comprises swaging the hollow tube on a mandrel.

In an embodiment, the deforming the wall of the hollow tube comprises swaging the hollow tube by drawing the hollow tube through a die.

In an embodiment, the deforming the wall of the hollow tube comprises rotary swaging the hollow tube.

In an embodiment, the deforming the wall of the hollow tube comprises ironing the wall of the hollow tube through at least one ironing die.

In an embodiment, the hollow tube is formed by deep drawing a blank of sheet material.

In an embodiment, the hollow tube comprises a metallic material.

In an embodiment, the metallic material is selected from at least one of: iron, iron alloys, stainless steel, mild steel, molybdenum, silicon carbide, aluminium, aluminium alloys, gold, copper, cupronickel alloys, iron-chromium-aluminium alloys, nickel aluminide alloys.

A second aspect of the invention provides a method of manufacturing an aerosol generation system heater element, the aerosol generation system heater element comprising a seamless hollow tube, the method comprising: coating a metallic layer on to an inner surface of a hollow tubular substrate.

In an embodiment, the method comprises extruding the hollow tubular substrate.

In an embodiment, the hollow tubular substrate comprises a ceramic material.

In an embodiment, the hollow tubular substrate comprises air channels between the inner surface of the hollow tubular substrate and an outer surface of the hollow tubular substrate.

In an embodiment, the hollow tubular substrate is a cylindrical tube has a circular cross section.

In an embodiment, the coating comprises electroplating the metallic layer on to the inner surface of the hollow tubular substrate.

In an embodiment, the coating comprises physically vapour depositing the metallic layer on to the inner surface of the hollow tubular substrate.

In an embodiment, the coating comprises chemically vapour depositing the metallic layer on to the inner surface of the hollow tubular substrate.

In an embodiment, the coating comprises thermally spraying the metallic layer on to the inner surface of the hollow tubular substrate.

In an embodiment, the metallic layer comprises a metallic material selected from at least one of: iron, iron alloys, stainless steel, mild steel, molybdenum, silicon carbide, aluminium, aluminium alloys, gold, copper, cupronickel alloys, iron-chromium-aluminium alloys, nickel aluminide alloys.

A third aspect of the invention provides an aerosol generation system heater element manufactured by the method according to the first aspect of the invention or manufactured by the method according to the second aspect of the invention.

A fourth aspect of the invention provides an aerosol generation system heater element comprising a seamless hollow tube, wherein the seamless hollow tube has a wall thickness of less than or equal to approximately 100 μm.

In an embodiment, the seamless hollow tube comprises a metallic material and wherein the metallic material is selected from at least one of: iron, iron alloys, stainless steel, mild steel, molybdenum, silicon carbide, aluminium, aluminium alloys, gold, copper, cupronickel alloys, iron-chromium-aluminium alloys, nickel aluminide alloys.

A fifth aspect of the invention provides an aerosol generation system heater element comprising a seamless hollow tube, wherein the seamless hollow tube comprises a metallic layer coated on an inner surface of a hollow tubular substrate.

In an embodiment, the metallic layer has a thickness less than or equal to approximately 100 μm.

In an embodiment, the metallic layer comprises a metallic material selected from at least one of: iron, iron alloys, stainless steel, mild steel, molybdenum, silicon carbide, aluminium, aluminium alloys, gold, copper, cupronickel alloys, iron-chromium-aluminium alloys, nickel aluminide alloys.

A sixth aspect of the invention provides an aerosol generation device comprising an aerosol generation system heater element according to the third, fourth, or fifth aspects of the invention, wherein the aerosol generation system heater element defines, at least in part, a receptacle for receiving an aerosol forming consumable.

In an embodiment, the aerosol generation device comprises a system for causing heating of the aerosol generation system heater element.

A seventh aspect of the invention provides an aerosol generation system comprising an aerosol generation device according to the sixth aspect of the invention and at least one aerosol forming consumable wherein the at least one aerosol forming consumable is shaped and sized to be receivable within the receptacle.

An eighth aspect of the invention provides an aerosol forming consumable comprising aerosolizable material and an aerosol generation system heater element according to the third, fourth, or fifth aspects of the invention, In an embodiment, the aerosol generation system heater element supports, at least in part, the aerosolizable material.

A ninth aspect of the invention provides an aerosol generation device, the aerosol generation device comprising a receptacle, wherein the receptacle is configured to receive an aerosol forming consumable according to the eighth aspect of the invention, and wherein the aerosol generation device comprises a system for causing heating of the aerosol generation system heater element of the aerosol forming consumable.

A tenth aspect of the invention provides an aerosol generation system comprising an aerosol generation device according to the ninth aspect of the invention at least one aerosol forming consumable according to the eighth aspect of the invention.

An eleventh aspect of the invention provides an aerosol generation system comprising: an aerosol forming consumable; an aerosol generation system heater element according to the third, fourth, or fifth aspects of the invention; and an aerosol generation device comprising a receptacle configured to receive the aerosol forming consumable and a system for causing heating of the aerosol generation system heater element.

Further features and advantages will become apparent from the following detailed description of certain examples, which are described with reference to the accompanying drawings.

BRIEF DESCRIPTION OF THE DRAWINGS

Certain examples will now be described with reference to accompanying drawings, in which:

FIG. 1 schematically illustrates an example of an aerosol generation system;

FIG. 2 schematically illustrates an example of an aerosol generation system heater element of an aerosol generation device and an aerosol forming consumable;

FIG. 3 schematically illustrates an example an aerosol forming consumable comprising an aerosol generation system heater element and aerosolizable material;

DETAILED DESCRIPTION

Figure 4:
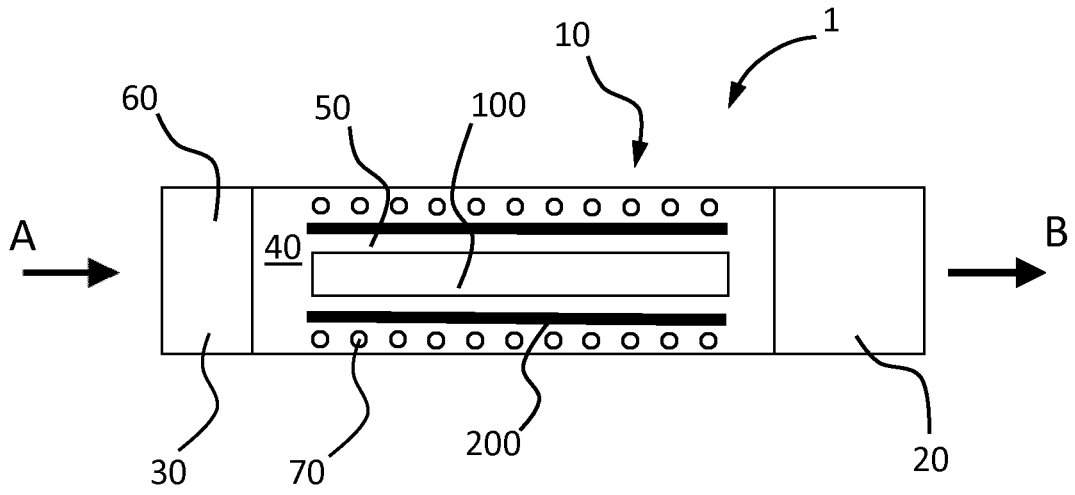
FIG. 4 schematically illustrates an example of an aerosol generation system.

Tobacco or non-tobacco products, of which at least one component is to be volatised, may be described as aerosolizable material(s). An 'aerosolizable material' is any suitable material from which an aerosol may be generated. In certain examples, an aerosol generated from an aerosolizable material may be generated by applying heat to the aerosolizable material.

In certain examples, the aerosolizable material may be a solid. In certain examples, the aerosolizable material may comprise a foam. In certain examples, the aerosolizable material may comprise a gel.

In certain examples, the aerosolizable material may be a tobacco material. In certain examples, the aerosolizable material may contain a nicotine source and no tobacco material. In certain examples, the aerosolizable material may contain a tobacco material and a separate nicotine source. In certain examples, the aerosolizable material may not contain a nicotine source. In certain examples, the aerosolizable material may contain a flavour.

In examples where the aerosolizable material comprises a gel, the gel may comprise a nicotine source. In some examples, the gel may comprise a tobacco material. In some cases, the gel may comprise a tobacco material and a separate nicotine source. For example, the gel may additionally comprise powdered tobacco or nicotine or a tobacco extract.

In certain examples where the aerosolizable material comprises a gel, the gel may comprise a gelling agent. The gelling agent may comprise a hydrocolloid. In certain examples where the aerosolizable material comprises a gel, the gel may comprise a hydrogel. The gel may additionally comprise a solvent.

In certain examples, where an aerosol is generated from heating an aerosolizable material, the aerosolizable material may be heated to temperatures between around 50° C. to around 250° C. or 300° C.

It may be noted that, in general, a vapour is a substance in the gas phase at a temperature lower than its critical temperature, which means that, for example, the vapour can be condensed to a liquid by increasing its pressure without reducing the temperature. On the other hand, in general, an aerosol is a colloid of fine solid particles or liquid droplets, in air or another gas. A colloid is a substance in which microscopically dispersed insoluble particles are suspended throughout another substance.

For reasons of convenience, as used herein, the term 'aerosol' should be taken as meaning an aerosol, a vapour or a combination of an aerosol and vapour.

As used herein, the term 'aerosolizable material' may, in certain examples, include an 'aerosol generating agent', which refers to an agent that promotes the generation of an aerosol. For example, where the aerosolizable material comprises a gel, the gel may comprise an aerosol generating agent. An aerosol generating agent may promote the generation of an aerosol by promoting an initial vaporisation or the condensation of a gas to an inhalable solid or liquid aerosol.

Suitable aerosol generating agents include, but are not limited to: a polyol such as sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate. The aerosol generating agent may suitably have a composition that does not dissolve menthol. The aerosol generating agent may suitably comprise, consist essentially of, or consist of, glycerol.

As used herein, the term 'aerosolizable material' may, in certain examples, include a 'flavour', that is a material that adds a flavour to a generated aerosol. As used herein, the term 'flavour' refers to materials which, where local regulations permit, may be used to create a desired taste or aroma in a product for adult consumers.

The term 'flavour' may include extracts (e.g., liquorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavour enhancers, bitterness receptor site blockers, sensorial receptor site activators or stimulators, sugars or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder. The flavour may suitably comprise one or more mint-flavours suitably a mint oil from any species of the genus Mentha. The flavour may suitably comprise, consist essentially of or consist of menthol.

As used herein, the term 'tobacco material' refers to any material comprising tobacco or derivatives therefore. The term 'tobacco material' may include one or more of tobacco, tobacco derivatives, expanded tobacco, reconstituted tobacco or tobacco substitutes. The tobacco material may comprise one or more of ground tobacco, tobacco fibre, cut tobacco, extruded tobacco, tobacco stem, reconstituted tobacco or tobacco extract.

The tobacco used to produce tobacco material may be any suitable tobacco, such as single grades or blends, cut rag or whole leaf, including Virginia or Burley or Oriental. It may also be tobacco particle 'fines' or dust, expanded tobacco, stems, expanded stems, and other processed stem materials, such as cut rolled stems. The tobacco material may be a ground tobacco or a reconstituted tobacco material. The reconstituted tobacco material may comprise tobacco fibres, and may be formed by casting, a Fourdrinier-based paper making-type approach with back addition of tobacco extract, or by extrusion.

The aerosolizable material comprising any of, or any combination of, the features and characteristics described above may be provided as a consumable article. The consumable article may be described as an aerosol forming consumable comprising an aerosolizable material from which an aerosol may be generated. In some examples, the aerosol forming consumable may include other materials and components in addition to the aerosolizable material. For example, the aerosol forming consumable may comprise a substrate on which the aerosolizable material is supported. For example, the aerosol forming consumable may comprise a handling feature that permits a user to handle the aerosol forming consumable without touching the aerosolizable material of the aerosol forming consumable.

FIG. 1 shows, schematically, an example aerosol generation system 1 for generating an aerosol from an aerosol forming consumable 100. The aerosol forming consumable may be receivable in an aerosol generation device 10 of the aerosol generation system 1. FIG. 1 may be considered to be a cross section through the aerosol generation system 1. The aerosol forming consumable 100 may be an example of the aerosol forming consumable comprising an aerosolizable material as described above.

The aerosol generation device 10 may include a housing 12 to support and retain the various components of the device 10. In certain examples, the aerosol generation device 10 may include a mouthpiece 20 through which a user of the device 10 may inhale an aerosol generated by the device 10. In certain examples, the aerosol generation device 10 may include an air inlet 30 through which air is drawn when the user inhales an aerosol generated by the device 10. In the example shown in FIG. 1, when the user inhales, air may be drawn in in the direction of arrow A and the user may inhale an aerosol in the direction of arrow B. In other examples, the aerosol generation device 10 may not include a mouthpiece. For example, a user of the device 10 may inhale an aerosol generated by the device 10 from the aerosol forming consumable 100 itself.

The aerosol generation device 10 may include a receptacle 40. The receptacle 40 may be configured to, in use, receive the aerosol forming consumable 100, such as the examples described above. The receptacle 40 may include an opening to receive the aerosol forming consumable 100. The aerosol forming consumable 100 may be shaped to fit within the receptacle 40. In certain examples, the aerosol forming consumable 100 may be a rod, or a stick, or a pod that corresponds to the internal shape of the receptacle 40. The receptacle 40 may be configured to allow air to pass from the air inlet 30 through the receptacle 40 and out to the mouthpiece 20 when the user inhales on the mouthpiece 20. The air through the receptacle 40, when the user inhales, may collect any generated aerosol from the aerosol forming consumable 100 before entering the user's mouth.

The aerosol generation system 1 may comprise an aerosol generation system heater element 200. The aerosol generation device system 1 may comprise a plurality of aerosol generation system heater elements 200.

In certain examples, the aerosol generation device 10 may comprise the aerosol generation system heater element 200. In some examples, the aerosol generation system heater element 200 may define, at least a portion of, the receptacle 40 in which the consumable 100 is received in the device 10. For example, the aerosol generation system heater element 200 may define a portion of the wall of the receptacle 40 in which the consumable 100 is received. In some examples, the aerosol generation system heater element 200 may form the greater portion of the receptacle 40 wall. In certain examples, where the aerosol generation system 1 comprises the plurality of aerosol generation system heater elements 200, the receptacle 40 may be defined, at least in part, by the plurality of the aerosol generation system heater elements 200. In certain examples, where the aerosol generation system 1 comprises the plurality of aerosol generation system heater elements 200, a plurality of receptacles 40 may be provided.

FIG. 2 shows one example of an aerosol generation system heater element 200 that defines, at least a portion of, the receptacle 40 in which the consumable 100 is received in the device 10. In this instance, the aerosol generation system heater element 40 defines, at least partially, a heating chamber 50 in which the aerosol forming consumable 100 is received. The heating chamber therefore, at least partially, surrounds the aerosolizable material contained within the aerosol forming consumable 100 such that, in use, the aerosolizable material be heated by the aerosol generation system heater element 200. The aerosol forming consumable 100 may be inserted into the heating chamber 50 in the direction of arrow C. In the instance shown in FIG. 2, the aerosol forming consumable 100 takes the form of an elongate cylinder and may be referred to as a rod, for example. As mentioned above, the aerosol forming consumable 100 may take any suitable form.

It will be understood that, in examples where the aerosol generation system heater element 200 is part of the aerosol generation device 10 and defines, at least partially, the receptacle 40, the heating chamber 50 and the receptacle 40 may be, at least partially, common features of the aerosol generation device 10. In other words, the heating chamber 50 may define a part of the receptacle 40 in which the aerosol forming consumable 100 is received in the device 10.

In certain examples, the aerosol forming consumable 100 may comprise the aerosol generation system heater element 200. In certain examples, the aerosol generation system heater element 200 may support aerosolizable material of the aerosol forming consumable 100. In certain examples, the aerosol generation system heater element 200 may be a substrate, such as the substrate mentioned above, on which the aerosolizable material is supported. In certain examples, the aerosol generation system heater element 200 may partially support the aerosolizable material. In certain examples, the aerosol forming consumable 100 may comprise other, or additional, substrate(s) that support the aerosolizable material. In certain examples, the aerosol generation system heater element 200 may wrap or encircle, at least in part, the aerosolizable material of the aerosol forming consumable 100. For example, the aerosol forming consumable 100 may comprise tobacco inserted inside the aerosol generation system heater element 200 thereby forming a rod or stick like aerosol forming consumable 100.

In some examples, the aerosol generation system heater element 200 may aid a user in handling the aerosol forming consumable 100 without touching the aerosolizable material of the aerosol forming consumable 100. In some examples, the aerosol generation system heater element 200 may form, at least a portion of, the external wrapper, wall, or casing of the aerosol forming consumable 100. In some examples, the aerosol generation system heater element 200 may encircle, at least a part of, the aerosolizable material of the aerosol forming consumable 100 and be wrapped by another wrapper. For example, the aerosol generation system heater element 200 may be wrapped by a paper wrapper or the like. The paper wrapper may, for instance, be marked to indicate the properties of the aerosol forming consumable 100, such as, for instance, the consumable's particular flavour or heating profile characteristics.

One example of an aerosol forming consumable 100 that comprises the aerosol generation system heater element 200 and aerosolizable material 101 is shown in FIG. 3. In this instance, the aerosol generation system heater element 200 partially wraps the aerosolizable material 101. The aerosolizable material 101 may be tobacco as described above, for example. In this instance, the aerosol forming consumable 100 takes the form of an elongate cylinder and may be referred to as a rod, for example. As mentioned above, the aerosol forming consumable 100 may take any suitable form.

In certain examples, where the aerosol generation system 1 comprises the plurality of aerosol generation system heater elements 200, the aerosol forming consumable 100 may comprise the plurality of aerosol generation system heater elements 200. In such examples, the plurality of aerosol generation system heater elements 200 may be arranged in any suitable arrangement. In some examples, the plurality of aerosol generation system heater elements 200 may define a plurality of substrates that support the aerosolizable material or individual segments of aerosolizable material. For example, the plurality of aerosol generation system heater elements 200 may be arranged concentrically. In other examples, the plurality of aerosol generation system heater elements 200 may be arranged successively along the length of the aerosol forming consumable 100.

The aerosol generation system heater element(s) 200 may comprise a seamless hollow tube as described further below. In FIG. 1, the aerosol generation system heater element 200 is schematically illustrated in cross section through the hollow tube shape of the illustrated aerosol generation system heater element 200.

The aerosol generation system heater element(s) 200 may be configured, when the aerosol generation system 1 is in use, to heat, at least a portion of, the aerosolizable material of the aerosol forming consumable 100. By heating at least a portion of the aerosol forming consumable 100, the aerosolizable material contained therein may be heated thereby generating an aerosol from the aerosolizable material. Activating the aerosol generation system heater element 200 may be triggered by the user inhaling air through the device 10 or by another means, for example by a switch.

In certain examples, the receptacle 40 may include a lid 60. The lid 60 may be a closable lid. The lid 60, when closed, may enclose the aerosol forming consumable 100 in the device 10. The lid 60, when closed, may enclose the receptacle 40 to form an enclosed passageway through which air is drawn from the air inlet 30 to the mouthpiece 20 by a user. The lid 60, when closed, may be configured to allow the aerosol generated from the aerosol forming consumable 100 to escape and be drawn through the mouthpiece 20.

The device 10 may include other componentry that is not shown in FIG. 1. The aerosol generation device 10 may include a system for causing heating of the aerosol generation system heater element 200. In certain examples, the device 10 may have a power unit, which holds a source of power which may be, for example, a battery, for providing electrical energy to the device 10. The device 10 may have electrical circuitry connected to the power source for conducting electrical energy to other components within the device 10. In certain examples, the circuitry may connect the power source to the system for causing heating of the aerosol generation system heater element 200.

The aerosol generation system heater element 200 may be configured to heat but not burn the aerosolizable material of the aerosol forming consumable 100. In certain examples, the aerosol generation system heater element 200 may heat the aerosolizable material of the aerosol forming consumable 100 by conducting heat to the aerosolizable material. In certain examples, the aerosol generation system heater element 200 may heat the aerosolizable material of the aerosol forming consumable 100 by radiating heat to the aerosolizable material. In certain examples, the aerosol generation system heater element 200 may heat the aerosolizable material of the aerosol forming consumable 100 by convection of heat to the aerosolizable material.

In certain examples, the aerosol generation system heater element 200 may comprise a metallic material. For example, the aerosol generation system heater element may comprise a metal material, an intermetallic material, or a metalloid. In certain examples, the aerosol generation system heater element 200 may comprise a ceramic material. In some examples, the aerosol generation system heater element 200 may be made from a mixture of metallic and non-metallic materials. For example, the aerosol generation system heater element 200 may be made from a mixture of a metal material and a ceramic material.

In examples where the aerosol generation system heater element 200 comprises a metallic material, the metallic material may be any suitable metallic material, for example, but not limited to, at least one of the following: iron, iron alloys such as stainless steel, mild steel, molybdenum, silicon carbide, aluminium, aluminium alloys, gold, copper, cupronickel alloys, iron-chromium-aluminium alloys, nickel aluminide alloys.

In examples where the aerosol generation system heater element 200 comprises a ceramic material, the ceramic material may be any suitable ceramic material, for example, but not limited to, at least one of the following: alumina, zirconia, yttria, calcium carbonate, and calcium sulphate.

In use, the system for causing heating of the aerosol generation system heater element 200 may cause the aerosol generation system heater element 200 to heat up, e.g., increase in temperature. Heating the aerosol generation system heater element 200 may be performed by any suitable heating arrangement.

In certain examples, the system for causing heating of the aerosol generation system heater element 200 may comprise heating the aerosol generation system heater element 200 by conduction. For example, a heat source may be placed in contact with the aerosol generation system heater element 200 and activated when the device 10 is in use.

In certain examples, the system for causing heating of the aerosol generation system heater element 200 may comprise an induction heating system to heat the aerosol generation system heater element 200.

Induction heating is a process of heating an electrically conductive object by electromagnetic induction. Where the electrically conductive object is then used to heat another element or item then the electrically conductive object may be called a 'susceptor'. The susceptor material may be formed of any suitable susceptor material, for example at least one of, but not limited to, the metallic materials identified above with respect to the aerosol generation system heater element 200. Thus, in certain examples, as used herein, the aerosol generation system heater element 200 may be a 'susceptor' in that it is heated by induction heating so that it may, in turn, may heat the aerosolizable material of the aerosol forming consumable 100. The heating of the aerosolizable material of the aerosol forming consumable 100, in turn, may primarily be by conducting or radiating heat to the aerosolizable material of the aerosol forming consumable 100 from the aerosol generation system heater element 200, for example.

Arranging the aerosol generation system heater element 200 as a susceptor may provide effective heating of the aerosolizable material of the aerosol forming consumable 100, which, in certain examples, may be substantially non-conductive. Furthermore, arranging the aerosol generation system heater element 200 as a susceptor may allow the heat pattern of the heat directed to the aerosolizable material of the aerosol forming consumable 100 to be controlled.

The induction heating system may comprise an electromagnet and a device for passing a varying electric current, such as an alternating electric current, through the electromagnet. The varying electric current in the electromagnet produces a varying magnetic field. The varying magnetic field penetrates the aerosol generation system heater element 200 suitably positioned with respect to the electromagnet, generating eddy currents inside the aerosol generation system heater element 200. The aerosol generation system heater element 200 has electrical resistance to the eddy currents, and hence the flow of the eddy currents against this resistance causes the aerosol generation system heater element 200 to be heated by Joule heating. In cases where the aerosol generation system heater element 200 comprises ferromagnetic material such as iron, nickel or cobalt, heat may also be generated by magnetic hysteresis losses in the aerosol generation system heater element 200, e.g., by the varying orientation of magnetic dipoles in the magnetic material as a result of their alignment with the varying magnetic field.

Induction heating, as compared to heating by conduction for example, may allow for rapid heating of the aerosol generation system heater element 200 since heat is generated inside the aerosol generation system heater element 200 (susceptor). Furthermore, there need not be any physical contact between the inductive heating system and the aerosol generation system heater element 200, allowing for enhanced freedom in construction, application, and reliability of the aerosol generation system 1.

An example of the aerosol generation system 1 in which the system for causing heating of the aerosol generation system heater element 200 comprises an induction heating system 70 to heat the aerosol generation system heater element 200 is shown in FIG. 4. Another example of the aerosol generation system 1 in which the system for causing heating of the aerosol generation system heater element 200 comprises an induction heating system 70 to heat the aerosol generation system heater element 200 is shown in FIG. 5.

Figure 5:
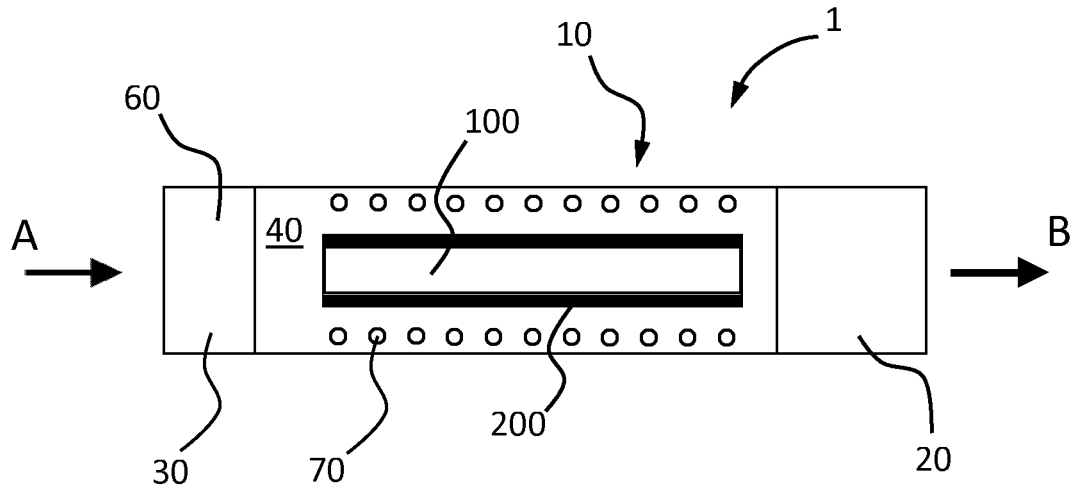
FIG. 5 schematically illustrates an example of an aerosol generation system.

FIGS. 4 and 5 show certain examples of a system for causing heating of the aerosol generation system heater element 200. For convenience and clarity, the system for causing heating of the aerosol generation system heater element 200 is not shown in any other figures.

As with the aerosol generation system 1, illustrated in FIG. 1, the aerosol generation devices 10 shown in FIGS. 4 and 5 include a mouthpiece 20 and an air inlet 30. The air inlet 30 may also act as a lid 60 covering user access to the receptacle 40 and allow a user to insert an aerosol forming consumable 100 into the aerosol generation device 10. In certain examples, the air inlet/lid may not be present on the device 10 and air may be drawn in through an open end of the device 10.

In the example aerosol generation system 1 shown in FIG. 4, and as described above, the aerosol generation device 10 comprises the aerosol generation system heater element 200. In the example of FIG. 4, the heating chamber 50 is defined by an aerosol generation system heater element 200 that is open at one end to allow the aerosol forming consumable 100 to be inserted into the heating chamber 50.

In the example aerosol generation system 1 shown in FIG. 5, and as described above, the aerosol forming consumable 100 comprises the aerosol generation system heater element 200. The aerosol generation system heater element 200 is, in use, inserted into the receptacle 40 of the device 10 with the aerosol forming consumable 100 through the access point of the receptacle.

As with the aerosol generation system 1 illustrated in FIG. 1, the aerosol generation system heater element 200 shown in FIGS. 4 and 5 may comprise a seamless hollow tube as described further below.

In FIG. 4, it can be seen that the induction heating system 70 comprises an induction coil that is wound around the aerosol generation system heater element 200. In FIG. 5, the induction heating system 70 comprises an induction coil that wraps around the aerosol generation system heater element 200 once the aerosol forming consumable 100 is received in the receptacle 40 of the aerosol generation device 10.

The induction coil is shown, schematically in FIGS. 4 and 5, as a cross section through the major axis of the coil, e.g., the helical axis of the coil. The cross section also cuts through the hollow tube shape of the illustrated aerosol generation system heater element 200.

When the induction coil is energised with an alternating current, the resulting varying magnetic field heats the aerosol generation system heater element 200 and, thereby, heats the aerosolizable material of the aerosol forming consumable 100 inserted into the receptacle 40.

In certain examples, the system for causing heating of the aerosol generation system heater element 200 may comprise the aerosol generation system heater element 200 arranged as an electrically resistive heater. Thus, the system for causing heating of the aerosol generation system heater element 200 may comprise circuitry for connecting the aerosol generation system heater element 200 a power source. In use, an electrical current from the power source may be passed through the aerosol generation system heater element 200 to cause Joule heating of the aerosol generation system heater element 200. The aerosol generation system heater element 200 may be any suitable material that forms an electrical conductor, for example a metallic material as described hereinabove. In an example, the system for causing heating of the aerosol generation system heater element 200 may comprise a controller that may control the electrical current passing through the aerosol generation system heater element 200 and therefore the amount of heat generated by the aerosol generation system heater element 200.

In certain examples, the system for causing heating of the aerosol generation system heater element 200 may comprise a thermal radiant heating system. In an example, the thermal radiant heating system may comprise a heat lamp that radiates thermal energy to the aerosol generation system heater element 200. For example, the thermal radiant heating system may comprise an infrared light source directed at the aerosol generation system heater element 200. For example, the thermal radiant heating system may comprise radiant heat sources such as LEDs or LASERs.

In certain examples, the system for causing heating of the aerosol generation system heater element 200 may comprise a chemical heating system. For example, system for causing heating of the aerosol generation system heater element 200 means may comprise a chemical heat source which undergoes an exothermic reaction to product heat in use.

Where the aerosol generation system 1 comprises the plurality of aerosol generation system heater elements 200, each aerosol generation system heater element 200 may be, in certain examples, provided with a respective system for causing heating of the aerosol generation system heater element 200. In other examples, a system for causing heating of the aerosol generation system heater element 200 may heat more than one aerosol generation system heater element 200. For example, where a plurality of heater elements 200 are arranged linearly or concentrically, for example, as described herein, a single system for causing heating or the heater element 200 may be provided, such as, for example, an induction heating coil that surrounds, when heating, all the aerosol generation system heater elements 200.

As already briefly mentioned above, the aerosol generation system heater element 200 may comprise a seamless hollow tube. A seamless hollow tube is a hollow tube that does not have a seam, which is a mark or a distortion in the material forming the hollow tube and which may result from certain manufacturing techniques that can be used to produce hollow tubes. Such a seam may, for example, run lengthwise along a hollow tube. Such seams may be undesirable due to the physical distortions on a hollow tube. The physical distortions may reduce the effectiveness of the aerosol generation system heater element 200 delivering heat to the aerosolizable material. The seams may also be undesirable because they may cause an uneven heat profile pattern throughout the aerosol generation system heater element 200 thereby causing uneven or poor heating of the aerosolizable material. The aerosol generation system heater element 200 may be manufactured according to the example methods described below.

FIGS. 2 and 3, which are mentioned above, illustrate examples of aerosol generation system heater elements 200 comprising a seamless hollow tube. In the particular examples shown in FIGS. 2 and 3, the seamless hollow tube has a substantially circular cross section such that the seamless hollow tube is substantially cylindrical along the length of the seamless hollow tube. In other aerosol generation system heater element 200 examples, the cross section of the seamless hollow tube may be substantially square, rectangular, conical, or elliptical, or any suitable shape, for example, so as to form any suitably shaped elongate hollow tube.

In the case of the example shown in FIG. 2, the heating chamber 50 is defined by the internal volume of the seamless hollow tube 200. In this instance, due to the circular cross section of the seamless hollow tube, the heating chamber 50 is substantially cylindrical in shape and, therefore, may receive therein a suitably sized and substantially cylindrical aerosol forming consumable 100. As mentioned above, the aerosol forming consumable 100 may be inserted into heating chamber 50 in the direction of arrow C. Where, in other aerosol generation system heater element 200 examples, the cross section of the seamless hollow tube takes another suitable shape, then the heating chamber 50 defined by the seamless hollow tube may receive therein a suitably sized and shaped aerosol forming consumable 100.

In the case where the aerosol generation system heater element 200 is a component of the aerosol generation device 10, such as in FIG. 2, a clearance may be provided between the aerosol generation system heater element 200 and the aerosol forming consumable 100 when it is initially inserted into the heating chamber 50. This may allow for easy insertion and extraction of the aerosol forming consumable 100 by a user of the aerosol generating device 10.

After an aerosol forming consumable 100 is received in the receptacle 40, and during operation of the aerosol generation system 1, the system for causing heating of the aerosol generation system heater element 200 may be actuated to so that the aerosol generation system heater element 200 heats the aerosolizable material of the aerosol forming consumable 100. The user may then inhale an aerosol generated in the receptacle 40.

The system for causing heating of the aerosol generation system heater element 200 may be deactivated when the temperature in the aerosolizable material of the aerosol forming consumable 100 consumable reaches a predetermined initial temperature. In certain examples, the system for causing heating of the aerosol generation system heater element 200 may be activated and deactivated as necessary to generate an aerosol whilst maintaining the aerosolizable material of the aerosol forming consumable 100 at a predetermined operating temperature. In other examples, the power level of the system for causing heating of the heater element 200 may be varied as necessary to generate an aerosol whilst maintaining the aerosolizable material of the aerosol forming consumable 100 at a predetermined operating temperature. The predetermined operating temperature may be the same as, or different from, the predetermined initial temperature, for example. In certain examples, the predetermined operating temperature may be varied as a user inhales the aerosol. For example, the predetermined operating temperature may be varied throughout a single inhalation of aerosol or varied over several inhalations. In certain instances, the predetermined operating temperature may be varied as the aerosol forming consumable is consumed.

A temperature or heat transfer sensor may be provided on the aerosol generation device 10 in order to monitor the temperature of the aerosolizable material of the aerosol forming consumable or heat transferred to the aerosol forming consumable 100. For example, a temperature sensor monitor may be installed inside the receptacle 40.

Figure 6:
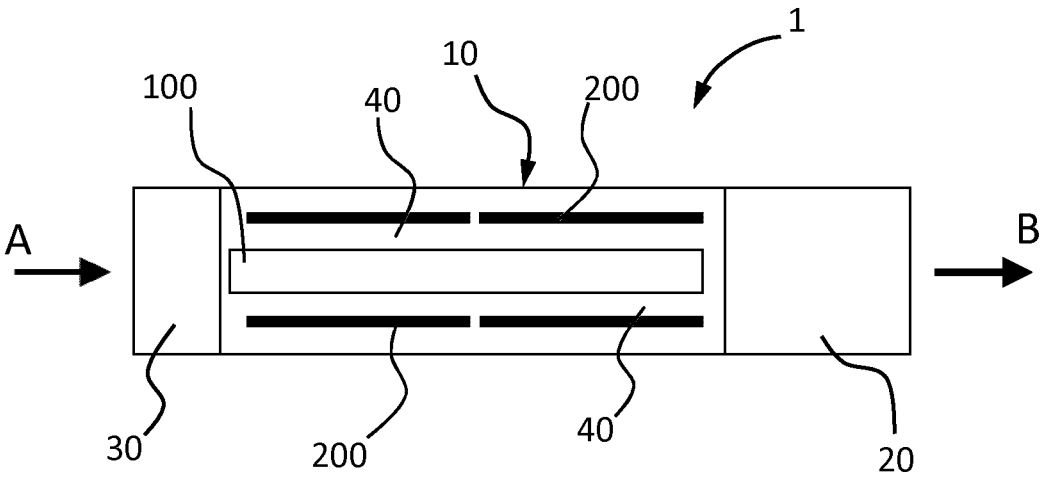
FIG. 6 schematically illustrates an example of an aerosol generation system.

As discussed above, in certain examples, the aerosol generation system heater element 200 may be one of a plurality of aerosol generation system heater elements 200. FIG. 6 illustrates an example aerosol generation device 10 in which two aerosol generation system heater elements 200 are provided. In other examples, any suitable number of heater elements 200 may be provided.

In the example of FIG. 6, the aerosol generation system heater elements 200 are arranged in series in the aerosol generation device 10 such that an elongate aerosol forming consumable 100 may be received within the receptacle 40 defined, at least in part, by the respective heater elements 200. It should be understood that a plurality of heater elements, such as the examples described herein, may be arranged in other ways in the aerosol generation device. For example, the plurality of heater elements be arranged in a radial array and configured to receive a corresponding plurality of aerosol forming consumables.

In the example shown in FIG. 6, the heater elements 200 may be actuated independently of one another such that different portions of the aerosol forming consumable 100 can be temperature controlled independently. For example, one portion of the aerosol forming consumable 100 may be heated before another portion of the aerosol forming consumable 100 so that the first portion is consumed by a user before the second portion. In another example, the aerosol forming consumable 100 may be kept at a predetermined temperature profile relative to its length as it is heated and consumed by a user of the device 10. For example, one portion of the aerosol forming consumable 100 may be kept at a higher temperature than another portion of the aerosol forming consumable 100. This may, for example, allow a flavour aerosol to be released from one portion of the aerosol forming consumable 100 whilst a nicotine carrying aerosol is released from another portion of the aerosol forming consumable 100.

FIG. 6 illustrates an example in which the heater elements 200 are components of the aerosol generation device 10. However, in other examples, the heater elements 200 may be components of the aerosol forming consumable 100, as described above, and may be activated in the same way as described herein with respect to FIG. 6.

Certain example methods of manufacturing an aerosol generation system heater element comprising a seamless hollow tube will now be described. The methods may, for example, be employed to manufacture any of the aerosol generation system heater element 200 example(s) described above.

The Applicant has found that, in certain examples, seamless hollow tubes having wall thicknesses less than approximately 100 μm may be formed using the methods described herein. The Applicant has also found that, in certain examples, seamless hollow tubes having a metallic layer less than approximately 100 μm thick coated on an internal surface of a hollow tubular substrate may be formed using the methods described herein. In certain examples, The Applicant has found that thin walls or layers of this thickness provide excellent heating performance. For example, inductive heating using such thin walls or layers has been found to be very efficient and to have fast heating or heat dissipation response times. The Applicant found that walls or layers of this thickness made from aluminium or aluminium alloys provided excellent heating performance.

In certain examples, the aerosol generation system heater element may comprise a seamless hollow tube with a wall thickness less than or equal to approximately 100 μm. In some examples, the seamless hollow tube may comprise a metallic material and have a wall thickness less than approximately 100 μm. The aerosol generation system heater element may be formed from a hollow tube according to the method(s) described below.

Accordingly, an aerosol generation system heater element may be provided comprising a seamless hollow tube in which the seamless hollow tube has a wall thickness of less than approximately 100 μm. In certain examples, the wall thickness may be less than 100 μm. In certain examples, the seamless hollow tube may comprise a metallic material. The metallic material may be selected from at least one of: iron, iron alloys, stainless steel, mild steel, molybdenum, silicon carbide, aluminium, aluminium alloys, gold, copper, cupronickel alloys, iron-chromium-aluminium alloys, nickel aluminide alloys.

In certain examples, the aerosol generation system heater element may comprise a seamless hollow tube comprising a hollow tubular substrate in which a metallic layer is coated on the inner surface of the hollow tubular substrate. In certain examples, the metallic layer may have a thickness less than or equal to approximately 100 μm. The aerosol generation system heater element may be formed by coating the metallic layer on a hollow tubular substrate according to the method(s) described below.

Accordingly, an aerosol generation system heater element may be provided comprising a seamless hollow tube in which the seamless hollow tube comprises a metallic layer coated on an inner surface of a hollow tubular substrate. In certain examples, the metallic layer may have a thickness less than approximately 100 μm. In certain examples, the metallic layer may comprise a metallic material. The metallic material may be selected from at least one of: iron, iron alloys, stainless steel, mild steel, molybdenum, silicon carbide, aluminium, aluminium alloys, gold, copper, cupronickel alloys, iron-chromium-aluminium alloys, nickel aluminide alloys.

An aerosol generation system may be provided that comprises an aerosol generation system heater element according to the example(s) described herein or manufactured according to the example method(s) described herein. The aerosol generation system may comprise an aerosol generation device. The aerosol generation device may comprise a receptacle configured to receive an aerosol forming consumable. The aerosol generation device may comprise a system for causing heating of the aerosol generation system heater element. The aerosol generation system may comprise at least one aerosol forming consumable.

The aerosol generation device may be according to the example(s) described herein. The aerosol forming consumable may be according to the example(s) described herein. The aerosol generation system may be provided as a kit of parts comprising the aerosol generation system heater element, the aerosol generation device, and one or more aerosol forming consumables.

An aerosol generation device may be provided that comprises an aerosol generation system heater element according to the example(s) described herein or manufactured according to the example method(s) described herein. In some examples, the aerosol generation system heater element of such an aerosol generation device may define, at least in part, a receptacle for receiving an aerosol forming consumable. In other examples, the aerosol generation system heater element of such an aerosol generation device may not define a receptacle, or a part thereof, for receiving an aerosol forming consumable. The aerosol generation device may comprise a system for causing heating of the aerosol generation system heater element. The aerosol generation device may be provided according to any of the examples described herein and, accordingly, in addition to the aerosol generation system heater element and system for causing heating of the aerosol generation system heater element, comprise other componentry that is necessary for the functioning of the aerosol generation device.

The aerosol generation device may be provided to a user as an aerosol generation system that contains at least one aerosol forming consumable for use with the aerosol generation device. The aerosol generation system may be provided as a kit of parts comprising the aerosol generation device and one of, or a plurality of like, aerosol forming consumables for use with the aerosol generation device. The at least one aerosol forming consumable may be shaped and sized to be receivable within the receptacle of the aerosol generation device. The aerosol forming consumable may be according to the example(s) described herein.

An aerosol forming consumable may be provided that comprises an aerosol generation system heater element according to the example(s) described herein or manufactured according to the example method(s) described herein. The aerosol forming consumable may comprise aerosolizable material. The aerosol generation system heater element of such an aerosol forming consumable may, at least partially, support the aerosolizable material of the aerosol forming consumable. The aerosol forming consumable may be according to the example(s) described herein.

An aerosol generation device may be provided that comprises a receptacle configured to receive the aerosol forming consumable. The aerosol generation device may comprise a system for causing heating of the aerosol generation system heater element. The aerosol generation device may be provided according to any of the examples described herein and, accordingly, in addition to the system for causing heating of the aerosol generation system heater element, comprise other componentry that is necessary for the functioning of the aerosol generation device.

The aerosol forming consumable and aerosol generation device may be provided to a user as an aerosol generation system. The aerosol generation system may be provided as a kit of parts comprising a plurality of like aerosol forming consumables for use with the aerosol generation device. The at least one aerosol forming consumable may be shaped and sized to be receivable within the receptacle of the aerosol generation device.

A method of manufacturing an aerosol generation system heater element may comprise deforming a wall of a hollow tube to form an aerosol generation system heater element comprising a seamless hollow tube in which a deformed wall of the seamless hollow tube is thinner than the wall of the hollow tube.

In certain examples, the hollow tube may comprise a metallic material as described hereinabove. For example, the metallic layer may comprise a metal material, an intermetallic material, or a metalloid.

Deforming the wall of the hollow tube to form a thinner deformed wall of the seamless hollow tube may involve reducing the cross-sectional area of the wall as it is deformed. The deforming may comprise plastically deforming the wall to form the seamless hollow tube.

Providing a relatively thin-walled hollow tube reduces the energy required to heat the aerosol generation system heater element relative to a thicker-walled hollow tube. Hence, less time is required to bring the aerosol generation system heater element up to the predetermined operating temperature. Furthermore, since there is less mass to heat, the aerosol generation system heater element is also more responsive to a change in the required operating temperature.

By deforming the wall of a relatively thick-walled tube that is already hollow, a relatively thin-walled hollow tube aerosol generation system heater element can be formed that lacks a seam on the hollow tube. The hollow tube from which the seamless hollow tube may itself be seamless before its wall is deformed.

Other methods of forming a thin-wall tube rely on, for example, joining two adjacent edges of a rolled-up sheet to form a tube. For example, the two adjacent edges may be welded together to form the join. However, a thin-walled tube formed in this way is not regular in shape since, as the sheet of material from which the tube is formed must also be relatively thin, the joining process results in distortions in the material near the join. Since the hollow tube has a distorted shape, any aerosol forming consumable received within the hollow tube may have irregular contact with the internal surface of the hollow tube. The variability in distance between the aerosol forming consumable and the internal surface of the hollow tube leads to non-uniform heating distribution across the aerosolizable material of the aerosol forming consumable. Hence, the process of heating the aerosol forming consumable will be inefficient thereby reducing the operating efficiency of the aerosol generation device.

For example, in the case of attempting to produce a cylindrically shaped thin-walled hollow tube by the edge joining process, the resulting tube will not be perfectly circular in cross section because of the local distortion near the joined edges of the thin sheet of material used to produce the hollow tube. A cylindrically shaped portion of aerosolizable material forming consumable will therefore make irregular contact with the distorted cylindrical wall of such a hollow tube and any heating of the aerosolizable material will be non-uniform.

Since the deformed wall of the seamless hollow tube lacks a seam, the seamless hollow tube can be produced in its desired shape without any of the distortions described above.

The thin-walled seamless hollow tube is thin-walled relative to the thick-walled hollow tube. Purely for example, the wall of the hollow tube may be between 1 to 3 times thicker than the wall of the seamless hollow tube. In some examples, the wall of the hollow tube may be between 1 to 1.3 times thicker than the wall of the seamless hollow tube.

Relatively thick-walled hollow tubes can be produced quickly, cheaply and simply. For example, thick-walled hollow tubes can be produced by way of drilling or boring a hole in any suitably shaped bar stock, for example circular bar stock. The relatively thick-wall hollow tube may also be produced by an extrusion process, for example.

In certain examples, the cross-sectional internal perimeter of the wall of hollow tube may be maintained as the wall of the hollow tube is deformed. As the cross-sectional internal perimeter of the wall is maintained during the wall deformation process, the deformed wall of the resulting seamless hollow tube may have the same cross-sectional internal perimeter as the wall of the hollow tube. As discussed further below, in other example methods, the cross-sectional internal perimeter of the wall of hollow tube may be lengthened as the wall of the hollow tube is deformed.

Thus, in manufacturing the aerosol generation system heater element comprising the seamless hollow tube, the wall of the hollow tube may have a first cross-sectional internal perimeter and the deformed wall of the seamless hollow tube may have a second cross-sectional internal perimeter that is at least the same length as the first cross-sectional internal perimeter.

Figure 7A:
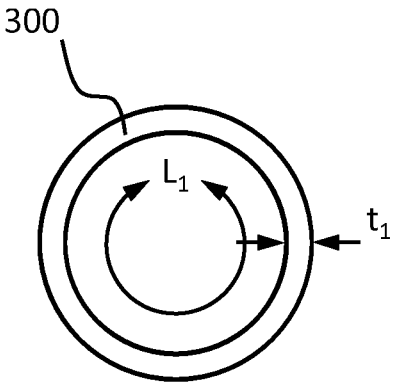
FIGS. 7A and 7B respectively schematically illustrate a hollow tube and an example of an aerosol generation system heater element comprising a seamless hollow tube.
Figure 7B:
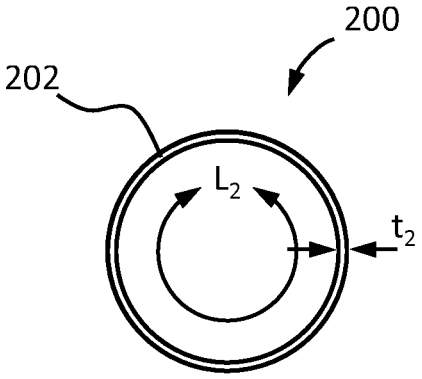

FIGS. 7A and 7B illustrate one example of an aerosol generation system heater element 200 comprising a seamless hollow tube 202 in which the deformed wall of the seamless hollow tube 202 has the same cross-sectional internal perimeter as the wall of a hollow tube 300 from which the seamless hollow tube 202 has been produced.

FIG. 7A illustrates a cross section through the hollow tube 300 prior to deforming the wall of the hollow tube 300. The hollow tube 300 has a wall with a thickness $t_1$ and a first cross-sectional internal perimeter $L_1$. FIG. 7B illustrates a cross section through the aerosol generation system heater element 200 comprising a seamless hollow tube 202 that has been produced from the hollow tube 300 The seamless hollow tube 202 has a deformed wall with a thickness $t_2$ and a second cross-sectional internal perimeter $L_2$. In the example shown in the FIGS. 7A and 7B, the second cross-sectional internal perimeter $L_2$ is the same length as the first cross-sectional internal perimeter $L_1$.

FIG. 7B also illustrates an example aerosol generation system heater element 200 in which the seamless hollow tube 202 has a substantially circular cross section such that the seamless hollow tube 202 is substantially cylindrical along the length of the seamless hollow tube 202. In certain examples, the seamless hollow tube 202 may be produced from a hollow tube 300 having substantially circular cross section such that the hollow tube 300 is substantially cylindrical along the length of the hollow tube 300, such as the example shown in FIG. 7A. In other examples, the seamless hollow tube 202 may be produced from a hollow tube that does not have a substantially circular cross section.

Accordingly, in an example where the hollow tube and seamless hollow tube both have a substantially circular cross section, and since the cross-sectional internal perimeter of the wall of hollow tube may be maintained as the wall is deformed, the deformed wall of the resulting seamless hollow tube may have the same cross-sectional internal circumference as the wall of the hollow tube. As a result, the internal diameter of the resulting seamless hollow tube may have the same internal diameter as the hollow tube. In this way, the deformed wall of the seamless hollow tube maintains the circular cross section of the hollow tube while providing the benefits of a thinner walled seamless hollow tube, as discussed above.

Thus, in manufacturing the aerosol generation system heater element comprising the seamless hollow tube, the wall of the hollow tube may have a first cross-sectional internal circumference and the deformed wall of the seamless hollow tube may have a second cross-sectional internal circumference that is at least the same length as the first cross-sectional internal circumference.

With regards to the example shown in FIGS. 7A and 7B, since the cross sections of the hollow tube 300 and the seamless hollow tube 202 are circular and since cross-sectional internal perimeter $L_2$ is the same length as the cross-sectional internal perimeter $L_1$, the deformed wall of the seamless hollow tube 202 has a second cross-sectional internal circumference that is the same length as a first cross-sectional internal circumference of the wall of the hollow tube 300.

In certain examples, the deforming the wall of the hollow tube may comprise swaging the hollow tube to form the seamless hollow tube. Swaging the hollow tube may comprise hot or cold forming of the hollow tube.

In certain examples, the deforming the wall of the hollow tube may comprises swaging the hollow tube on a mandrel. Swaging the hollow tube on a mandrel may stretch the wall of the hollow tube as it is forced over or against the mandrel. Swaging the hollow tube on a mandrel may reduce the cross-sectional area of the wall as it is deformed. The mandrel may be placed inside the hollow tube before the deforming of the wall. The hollow tube may be slid over the mandrel before the deforming of the wall.

In certain examples, the deforming the wall of the hollow tube may comprise swaging the hollow tube by drawing the hollow tube through a die. Drawing may include pushing or pulling the hollow tube through the die. For example, a mandrel may be placed inside the hollow tube and the hollow tube then drawn through a die and over the mandrel such that the mandrel defines the internal dimensions of the seamless hollow tube and the die defines the external dimensions of the seamless hollow tube.

For example, in the case of a circular cross sectional seamless hollow tube as described above, the mandrel may define the cross-sectional internal circumference of the seamless hollow tube and the die may define the cross-sectional external circumference of the seamless hollow tube.

Figure 8:
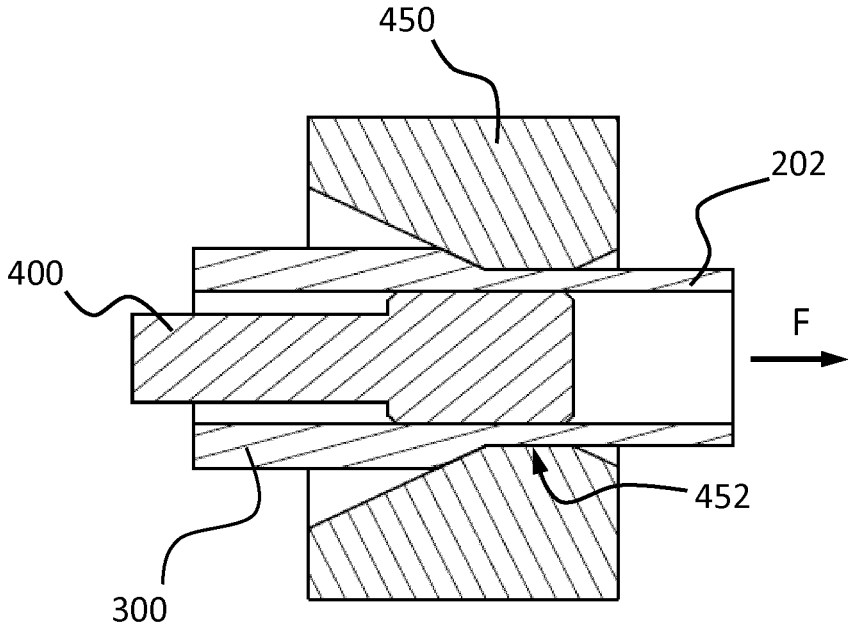
FIG. 8 schematically illustrates a hollow tube in the process of being drawn through a die.

An example of a hollow tube in the process of being drawn through a die and over a mandrel is shown in FIG. 8. A mandrel 400 is placed inside a hollow tube 300. The mandrel may define the internal dimensions of the seamless hollow tube 202. A die 450 surrounds the hollow tube 300 and has a throat 452 through which the hollow tube 300 passes as it is drawn through the die 450. The hollow tube 300 is drawn through the die 450 in the direction of arrow F. Together with the mandrel 300, the throat 452 defines the wall thickness of the seamless hollow tube 202.

In certain examples, the deforming the wall of the hollow tube may comprise swaging the hollow tube by rotary swaging the hollow tube. In such examples, the hollow tube may be mounted or slid over a mandrel. A swaging tool may then be forced against the external surface of the hollow tube to squeeze the wall of the hollow tube against the mandrel thereby thinning the wall of the hollow tube to form the seamless hollow tube. In certain examples, the mandrel or the swaging tool may rotate such that the hollow tube rotates relative to the swaging tool during the swaging process. The swaging tool may, for example, a shaped die that moves radially inwardly and outwardly with respect to the mandrel in order to apply pressure to the hollow tube on the mandrel in order to produce the seamless hollow tube.

Figure 9:
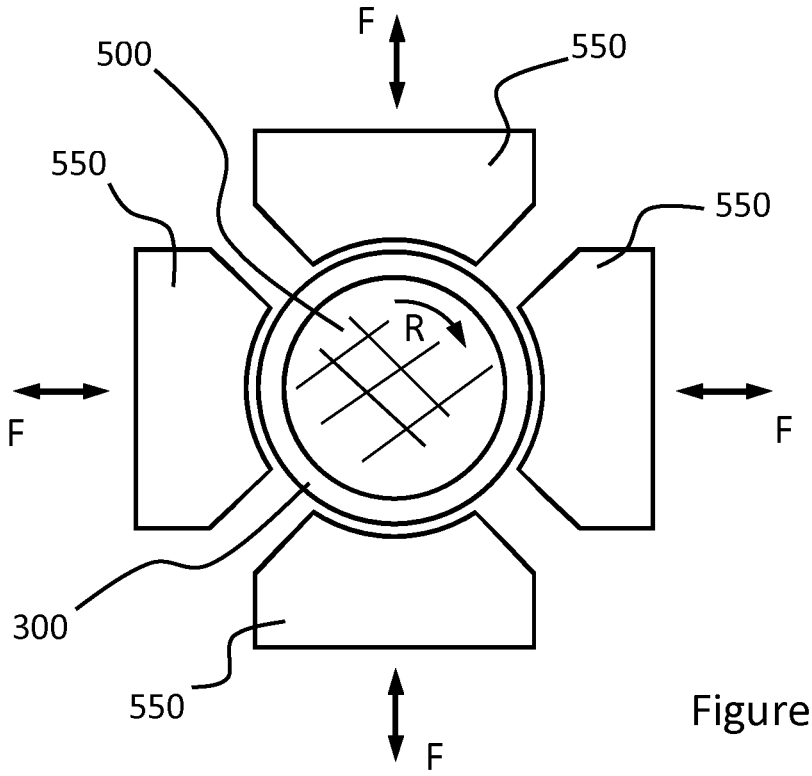
FIG. 9 schematically illustrates a rotary swaging process of a hollow tube.

FIG. 9 shows one example of a rotary swaging process in which a hollow tube 300 is rotary swaged. The hollow tube 300 is mounted on a mandrel 500. During the swaging process the mandrel may rotate as indicated by arrow R. The mandrel may rotate in any direction. Four shaping dies 550 are arranged around the mandrel 500. During the swaging process the shaping dies may move radially inwards and outwards to apply pressure to the surface of the hollow tube 300 thereby deforming and thinning the wall of the hollow tube 300 to form the seamless hollow tube. For example, the shaping dies 550 may move as indicated by arrows F In other examples, the shaping dies 550 may rotate relative to the hollow tube 300. Any suitable number of shaping dies 550 may be provided, for example two or four shaping dies 550. is that is arranged to rotate the hollow tube.

As briefly discussed above, in certain examples, the cross-sectional internal perimeter of the wall of hollow tube may be lengthened as the wall of the hollow tube is deformed. Hence, in manufacturing the aerosol generation system heater element comprising the seamless hollow tube, the deformed wall of seamless hollow tube may have a second cross-sectional internal perimeter that is longer than the first cross-sectional internal perimeter of the wall of the hollow tube.

In examples where the where the hollow tube and seamless hollow tube both have a substantially circular cross section, the deformed wall of the seamless hollow tube may have a second cross-sectional internal circumference that is longer than the first cross-sectional internal circumference of the wall of the hollow tube.

In certain examples, the deforming the wall of the hollow tube may comprise internally swaging the hollow tube to form the seamless hollow tube. Internally swaging the hollow tube may comprise hot or cold forming of the hollow tube. The internal swaging may comprise use of a tool that expands or rotates inside the hollow tube to deform the wall of the hollow tube. In other examples, the internal swaging may comprise the use of a flexible tool to expand the hollow tube thereby deforming the wall of the hollow tube. For example, the wall of the hollow tube may be expanded using an inflatable tool. In certain examples, deforming the wall of the hollow tube may comprise hydroforming the hollow tube to expand the first cross-sectional internal perimeter of the wall of the hollow tube to produce the longer second cross-sectional internal perimeter of the deformed wall of the seamless hollow tube. Hydroforming stretches the wall of the hollow tube thereby lengthening it and forming a longer, thinner, deformed wall of the seamless hollow tube. Hydroforming also increases or expands the internal volume of the hollow tube as the wall deforms and thins to produce the seamless hollow tube. It should be understood that hydroforming the hollow tube to deform the wall may be used on any suitably shaped hollow tube.

Figure 10:
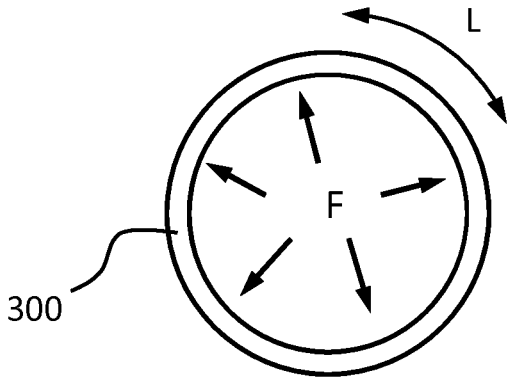
FIG. 10 schematically illustrates a hollow tube undergoing hydroforming.

FIG. 10 schematically illustrates the cross section of a hollow tube 300 undergoing hydroforming. In certain examples, the hollow tube 300 may be placed in a die that defines the desired outer dimensions of the seamless hollow tube. Open ends of the hollow tube 300 may be sealed by plugs. Hydraulic fluid may then be pumped into the inside of the hollow tube 300 and pressurised such that the wall of the hollow tube expands against the die. The hydraulic fluid may be, for example, a water-based fluid. The water-based fluid may contain lubricants, for example.

The wall of the hollow tube plastically deforms under the pressure of the pressurised hydraulic fluid and expands to the desired final dimensions as set by the surrounding die. In FIG. 10, the arrows F indicate the direction of pressure exerted on the wall of the hollow tube 300 as it expands to form a seamless hollow tube. As the hollow tube 300 expands under the pressure of the hydraulic fluid, the first cross-sectional internal perimeter of the wall of the hollow tube 300 lengthens in the direction of arrow L in FIG. 10.

In certain examples, the deforming the wall of the hollow tube may comprise ironing the wall of the hollow tube through at least one ironing die. Ironing the wall of the hollow tube may uniformly thin the wall of the hollow tube to form the deformed wall of the seamless hollow tube. As the hollow tube passes through the ironing die, the length of the hollow tube is stretched as the wall thins and forms the deformed wall of the seamless hollow tube.

Figure 11:
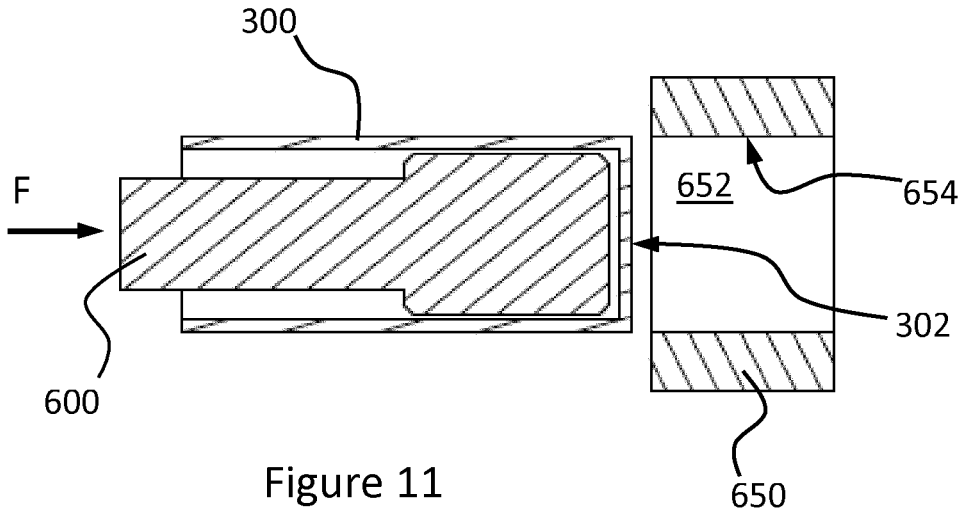
FIG. 11 schematically illustrates a hollow tube being punched through an ironing die.

FIG. 11 shows an example in which the wall of a hollow tube 300 is ironed through an ironing die 650. The hollow tube is pushed in the direction of arrow F by a punch 600, which forces the hollow tube through an opening 652 in the ironing die 650. The opening 652 in the ironing die 650 comprises a surface 654 that corresponds to the desired outer shape of the seamless hollow tube 202. The opening 652 may have internal dimensions that are smaller than the outer dimensions of the hollow tube 300 prior to processing. The internal dimensions of the opening 652 and the outer dimensions of the punch 600 may be arranged such that the wall of the hollow tube 300 is squeezed as it is forced through the opening 652 of the ironing die 650 thereby thinning the wall and lengthening the hollow tube to form the seamless hollow tube 202.

In certain examples, where the hollow tube 300, as described above, has a substantially circular cross section such that the hollow tube 300 is substantially cylindrical along the length of the hollow tube 300, the opening 652 of the ironing die 650 may have a correspondingly circular cross section. In other examples, where the hollow tube 300 and seamless hollow tube 202 take another suitable shape, the opening 652 of the ironing die 650 may have a shape corresponding to that suitable shape.

In certain examples, such as the example shown in FIG. 11, the hollow tube 300 may comprise a closed end 302 that aids the punch 600 in applying the ironing force to the hollow tube 300. Thus, in some cases the hollow tube 300 may take the form of a cup, as shown in FIG. 11.

In certain examples, the hollow tube 300 may be successively ironed through a plurality of ironing dies in which each successive ironing die progressively thins the wall of the hollow tube 300 and lengthens the hollow tube 300. Progressively ironing the hollow tube 300 through multiple ironing dies may allow the metallic material to be stretched whilst reducing the risk of tearing or otherwise damaging the wall of the hollow tube 300 during processing.

In some examples, it may be necessary to remove excess material from the resulting seamless hollow tube 202 following the ironing process. For example, the ends of the seamless hollow tube 202 may be trimmed to the desired final dimensions of the seamless hollow tube 202. In certain examples, where the hollow tube 300 comprises a closed end 302 as shown in FIG. 11, the closed end 302 may be sheared from the formed seamless hollow tube 202 following the ironing of the hollow tube.

In certain examples, the hollow tube 300, such as the example shown in FIG. 11 may be formed by deep drawing a blank of sheet material. For example, a flat blank may be punched from a sheet of metal and then deep drawn to form the cup.

A method of manufacturing an aerosol generation system heater element may comprise coating a metallic layer on to an inner surface of a hollow tubular substrate to form an aerosol generation system heater element comprising a seamless hollow tube.

The metallic layer may comprise a metallic material as described hereinabove. For example, the metallic layer may comprise a metal material, an intermetallic material, or a metalloid.

Using a hollow tubular substrate provides structural stability and rigidity to the seamless hollow tube whilst enabling the thickness of metallic layer to be controlled accurately. The structural stability provided by the hollow tubular substrate allows a thin metallic layer to be formed.

Providing a metallic layer on the inner surface of a hollow tubular substrate allows the energy required to heat the aerosol generation system heater element to be reduced since the metallic layer can be deposited thinly on the hollow tubular substrate. Hence, less time is required to bring the aerosol generation system heater element up to the predetermined operating temperature in comparison with a heater element made from a relatively thick-walled tube, such as a tube made by drilling a hole in circular bar stock. Furthermore, since there is less mass to heat, the aerosol generation system heater element is also more responsive to a change in the required operating temperature.

Since the metallic layer is coated on a tubular substrate, an aerosol generation system heater element can be formed that has a tubular metallic layer that lacks a seam on the tubular metallic layer. As discussed above, other methods of forming a thin-walled tubular shape that can be used as a heater element rely on joining sheet materials and the joining processes result in distortions in the material near the join. Since the tubular metallic layer lacks a seam, the seamless hollow tube can be produced in its desired shape without any of the distortions described above.

Figure 12:
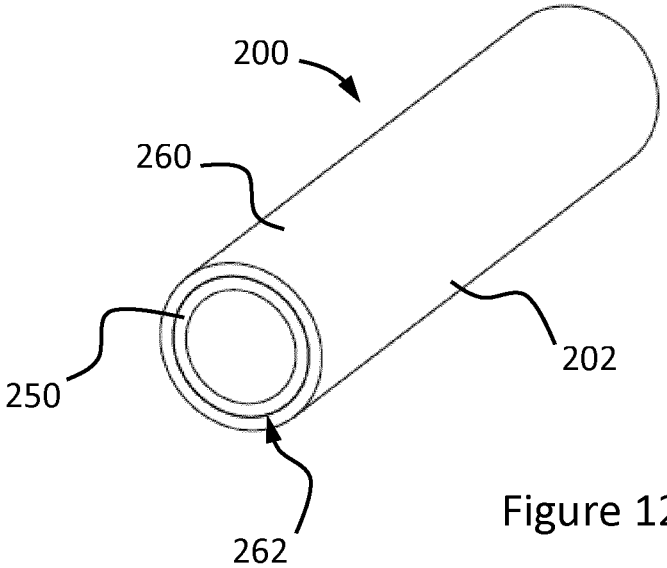
FIG. 12 schematically illustrates example of an aerosol generation system heater element.

FIG. 12 shows an example of an aerosol generation system heater element 200 manufactured by the described coating method. The aerosol generation system heater element 200 comprises a seamless hollow tube 202. The seamless hollow tube 202 comprises a metallic layer 250 deposited on to an inner surface 262 of a hollow tubular substrate 260. In the example shown in FIG. 9, the hollow tubular substrate 260 has a circular cross section such that the hollow tubular substrate 260 is substantially cylindrical along the length of the hollow tubular substrate 260. Hence, the metallic layer 250 and the seamless hollow tube 202 also have circular cross sections and are substantially cylindrical along the length of the seamless hollow tube 202. In other aerosol generation system heater element examples, the cross section of the hollow tubular substrate may be substantially square, rectangular, or elliptical, or any suitable shape, for example, so as to form any suitably seamless hollow tube.

The hollow tubular substrate may be any suitable material than can support the coating of the required metallic layer and remain structurally sound at the required operational temperatures.

In certain examples, the hollow tubular substrate may be formed from a ceramic material. The ceramic material may comprise any of the ceramic materials as described hereinabove. For example, the hollow tubular substrate may be formed from at least one of the following: alumina, zirconia, yttria, calcium carbonate, and calcium sulphate.

In certain examples, the hollow tubular substrate may be produced using a ceramic slurry. The ceramic slurry may be formed into the desired shape and then be left to set and to dry. The ceramic slurry may be formed into the desired shape by casting or moulding the ceramic slurry. The ceramic slurry may then be fired to make the ceramic hard and rigid and thereby form the hollow tubular substrate comprising a ceramic material.

In certain examples, the hollow tubular substrate may be made by sintering, by application of pressure, or any other technique for forming a porous ceramic. For example, the hollow tubular substrate may be manufactured through isostatic pressing, plastic forming (jiggering, extruding or injection moulding, for example), or by casting.

In some examples, the hollow tubular substrate may be made by sintering ceramic powder. The ceramic powder may be pressed or moulded into the ultimate shape of the hollow tubular substrate before the powder is sintered.

In certain examples, the method of manufacturing the aerosol generation system heater element may comprise extruding the hollow tubular substrate. The hollow tubular substrate may be extruded from any suitable material.

In certain examples, the hollow tubular substrate may be extruded from any of the ceramic materials described herein above. For example, the hollow tubular substrate may be formed by extruding a ceramic slurry in a tubular shape. The extruded ceramic slurry may then be fired to make the ceramic hard and rigid in the desired shape of the hollow tubular substrate.

In certain examples, the hollow tubular substrate may be provided with air channels between the inner surface of the hollow tubular substrate and an outer surface of the hollow tubular substrate. The air channels may insulate the metallic layer of the seamless hollow tube thereby increasing the efficiency of the aerosol generation system heater element since the heat energy lost through the hollow tubular substrate will be reduced in operation.

In examples where the hollow tubular substrate is formed from a ceramic material, the ceramic material may be porous such that it forms the air channels between the inner surface of the hollow tubular substrate and an outer surface of the hollow tubular substrate. The necessary porosity of the ceramic material may be provided by sintering ceramic powder to form the hollow tubular substrate.

The metallic layer may be coated on the hollow tubular substrate by any suitable coating method in which the metallic layer is attached to the hollow tubular substrate.

In certain examples, the coating of the hollow tubular substrate may involve coating the metallic layer atom-by-atom or molecule-by-molecule, for example. In certain examples, the metallic layer may be coated to the hollow tubular substrate by depositing the metallic material of the metallic layer on to the hollow tubular substrate.

In certain examples, the depositing of the metallic layer may comprise electroplating the metallic layer on to the inner surface of the hollow tubular substrate.

In certain examples, the depositing of the metallic layer may comprise physical vapour deposition of the metallic layer on to the inner surface of the hollow tubular substrate.

In certain examples, the depositing of the metallic layer may comprise chemical vapour deposition of the metallic layer on to the inner surface of the hollow tubular substrate.

In certain examples, the depositing of the metallic layer may comprise thermal spraying the metallic layer on to the surface of the hollow tubular substrate.

The various embodiments described herein are presented only to assist in understanding and teaching the claimed features. These embodiments are provided as a representative sample of embodiments only, and are not exhaustive or exclusive. It is to be understood that advantages, embodiments, examples, functions, features, structures, or other aspects described herein are not to be considered limitations on the scope of the invention as defined by the claims or limitations on equivalents to the claims, and that other embodiments may be utilised and modifications may be made without departing from the scope of the claimed invention. Various embodiments of the invention may suitably comprise, consist of, or consist essentially of, appropriate combinations of the disclosed elements, components, features, parts, steps, means, etc, other than those specifically described herein. In addition, this disclosure may include other inventions not presently claimed, but which may be claimed in future.

The invention claimed is:

1. A method of manufacturing an aerosol generation system induction heater element, the method comprising:

deforming a wall of a hollow tube to form a seamless susceptor, the seamless susceptor having a deformed wall, wherein the deformed wall of the seamless susceptor is thinner than the wall of the hollow tube; and forming a receptacle defined, at least in part, by the aerosol generation system induction heater element, to receive an aerosol forming consumable.

2. The method according to claim 1, wherein the wall of the hollow tube has a first cross-sectional internal perimeter prior to deformation and wherein the deformed wall of the seamless susceptor has a second cross-sectional internal perimeter following deformation that is at least the same length as the first cross-sectional internal perimeter.

3. The method according to claim 1, wherein the deformed wall of the seamless susceptor has a second cross-sectional internal perimeter that is longer than the first cross-sectional internal perimeter.

4. The method according to claim 1, wherein the deforming the wall of the hollow tube comprises hydroforming the hollow tube to expand a first cross-sectional internal perimeter of the hollow tube.

5. The method according to claim 1, wherein the deforming the wall of the hollow tube comprises swaging the hollow tube on a mandrel, drawing the hollow tube through a die, or rotary swaging the hollow tube.

6. The method according to claim 1, wherein the deforming the wall of the hollow tube comprises ironing the wall of the hollow tube through at least one ironing die.

7. The method according to claim 6, wherein the hollow tube is formed by deep drawing a blank of sheet material.

8. The method according to claim 1, wherein the hollow tube comprises a metallic material.

9. The method according to claim 8, wherein the metallic material is selected from at least one of: iron, iron alloys, stainless steel, mild steel, molybdenum, silicon carbide, aluminium, aluminium alloys, gold, copper, cupronickel alloys, iron-chromium-aluminium alloys, nickel aluminide alloys.

10. A method of manufacturing an aerosol generation system induction heater element, the aerosol generation system heater element comprising a seamless hollow tube forming a susceptor, the method comprising:

forming a receptacle defined, at least in part, by the aerosol generation system induction heater element, to receive an aerosol forming consumable; and coating a metallic layer on to an inner surface of a hollow tubular substrate.

11. The method according to claim 10, wherein the method comprises extruding the hollow tubular substrate.

12. The method according to claim 10, wherein the hollow tubular substrate comprises a ceramic material.

13. The method according to claim 10, wherein the hollow tubular substrate comprises air channels between the inner surface of the hollow tubular substrate and an outer surface of the hollow tubular substrate.

14. The method according to claim 10, wherein the coating comprises electroplating the metallic layer on to the inner surface of the hollow tubular substrate.

15. The method according to claim 10, wherein the coating comprises physically vapor depositing, chemically vapor depositing, or thermally spraying the metallic layer on to the inner surface of the hollow tubular substrate.

16. The method according to claim 10, wherein the metallic layer comprises a metallic material selected from at least one of: iron, iron alloys, stainless steel, mild steel, molybdenum, silicon carbide, aluminium, aluminium alloys, gold, copper, cupronickel alloys, iron-chromium-aluminium alloys, nickel aluminide alloys.

17. An aerosol generation system induction heater element comprising a seamless hollow tube forming a susceptor that defines, at least in part, a receptacle to receive an aerosol forming consumable, wherein the seamless hollow tube has a wall thickness of less than or equal to approximately 100 μm.

18. The aerosol generation system heater element according to claim 17, wherein the seamless hollow tube comprises a metallic material and wherein the metallic material is selected from at least one of: iron, iron alloys, stainless steel, mild steel, molybdenum, silicon carbide, aluminium, aluminium alloys, gold, copper, cupronickel alloys, iron-chromium-aluminium alloys, nickel aluminide alloys.

19. The aerosol generation system heater element according to claim 18, wherein the seamless hollow tube comprises a metallic layer coated on an inner surface of a hollow tubular substrate.

20. The aerosol generation device according to claim 17, wherein the aerosol generation device comprises a system for causing heating of the aerosol generation system heater element.

* * * * *